US009439492B2

(12) United States Patent
Johnson

(10) Patent No.: US 9,439,492 B2
(45) Date of Patent: Sep. 13, 2016

(54) WRAP-N-DRY TOWEL

(71) Applicant: Cherney Johnson, Sherman Oaks, CA (US)

(72) Inventor: Cherney Johnson, Sherman Oaks, CA (US)

( * ) Notice: Subject to any disclaimer, the term of this patent is extended or adjusted under 35 U.S.C. 154(b) by 101 days.

(21) Appl. No.: 14/121,623

(22) Filed: Sep. 29, 2014

(65) Prior Publication Data

US 2016/0088979 A1 Mar. 31, 2016

(51) Int. Cl.
*A45D 20/00* (2006.01)
*A42B 1/04* (2006.01)

(52) U.S. Cl.
CPC ..... *A45D 20/00* (2013.01); *A42B 1/041* (2013.01)

(58) Field of Classification Search
CPC ..... F26B 3/00; F26B 5/00; F26B 19/00; F26B 21/00; A45D 8/40; A45D 20/00; A47K 10/00; A42B 1/00; A42B 1/04
USPC ..... 34/97, 99, 98, 103; 2/111, 174, 202; D30/158; 132/200, 212
See application file for complete search history.

(56) References Cited

U.S. PATENT DOCUMENTS

| | | | | | |
|---|---|---|---|---|---|
| 3,235,882 | A * | 2/1966 | Coleman | A45D 44/12 | 2/174 |
| 4,110,846 | A * | 9/1978 | Hernandez | A41D 23/00 | 2/203 |
| 5,062,157 | A * | 11/1991 | Muta | A41D 20/00 | 2/171 |
| 6,389,597 | B1 * | 5/2002 | Henegan | A41B 13/06 | 2/69.5 |
| 6,505,367 | B2 * | 1/2003 | Griffin | A47D 5/006 | 2/48 |
| 6,536,047 | B1 * | 3/2003 | Mullaly | A41B 13/06 | 2/48 |
| D601,327 | S * | 10/2009 | Anderson | D2/825 | |
| 8,327,476 | B1 * | 12/2012 | Paratore | 5/417 | |
| D711,073 | S * | 8/2014 | Peters | D2/825 | |
| 2010/0257653 | A1 * | 10/2010 | Pitts | A41B 13/06 | 2/69.5 |
| 2014/0020176 | A1 * | 1/2014 | Coates | A41B 13/065 | 5/494 |
| 2014/0352167 | A1 * | 12/2014 | Peters | A47K 10/02 | 34/353 |

* cited by examiner

*Primary Examiner* — Stephen M Gravini
(74) *Attorney, Agent, or Firm* — Integrity Patent Group, "PLC"

(57) ABSTRACT

The Wrap-n-Dry Towel has a hook strip on one side of the towel and a loop strip on the opposite side of the towel. When the towel is wrapped around a person's head to the forehead and the hook and loop are pressed together it provides a strong wrap. The towel is never twisted into a knot and is loose on the hair and allows the hair and towel to drape down the back side of the person allowing faster drying of the hair and preventing tangling of the hair for a healthier strand of hair and ease of brushing the hair out.

3 Claims, 6 Drawing Sheets

WRAP-N-DRY TOWEL

BACKGROUND OF THE INVENTION (1) Field of the Invention

The Wrap-n-Dry Towel is a new type of towel for drying hair in a more open style than existing towels used in salons or spas.

(2) Description of the Art

Including information disclosed under 37 CFR 1.97 & 1.98 The art described in the drawings of the design and utility function illustrate the unique ability of the Wrap-n-Dry Towel and we found one patent, Leach U.S. Pat. No. 6,427,251 B1 and is similar in nature however it does not fold the same way with the same method of use. The patent cited folds into a turban style while the Wrap-n-Dry Towel stays into an open style to allow better drying of the hair with no causing of hair tangling or breaking strands of hair.

BRIEF SUMMARY OF THE INVENTION

The Wrap-n-Dry Towel is a unique design with a functionality that uses two hook and loop strips to hold the towel in place on the head and allows more air to reach the hair and not break strands of hair.

BRIEF DESCRIPTION OF THE SEVERAL VIEWS OF THE DRAWINGS

There are 6 drawings in total that describe and illustrate the design and function of the Wrap-n-Dry Towel. The person and hair shown in broken lines are not a part of this specification and are for illustration purposes only.

DETAILED DESCRIPTION OF THE PREFERRED EMBODIMENT

The person and hair shown in broken lines are not a part of this specification and are for illustration purposes only.

Figure 1:
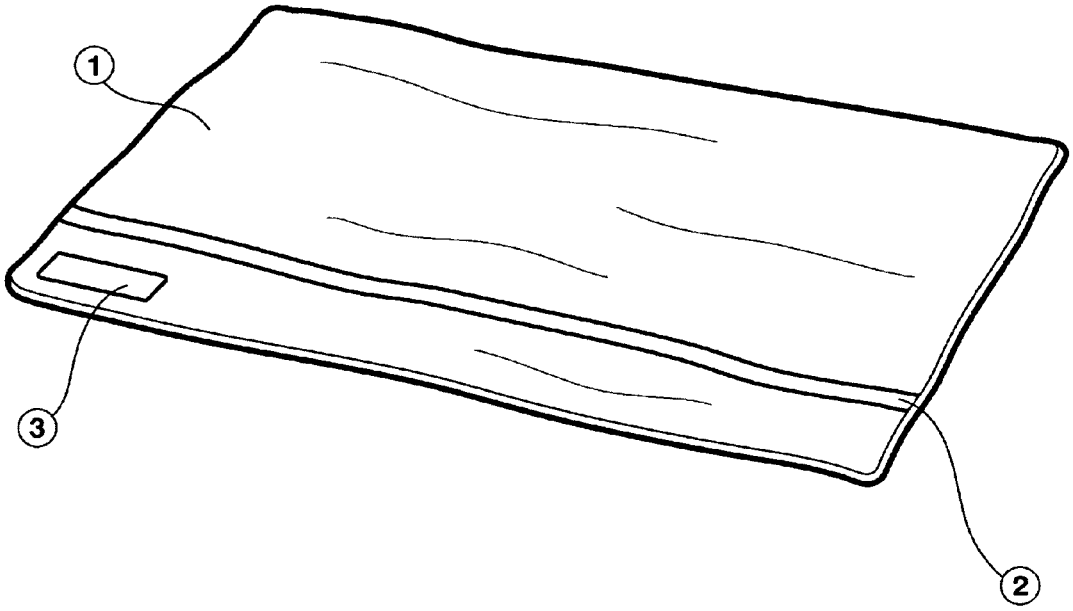
FIG. 1: is the top view of the towel.

FIG. 1: In this top view illustration #1 is the top side of the towel with #2 the decorative strip or logo with #3 the hook portion.

Figure 2:
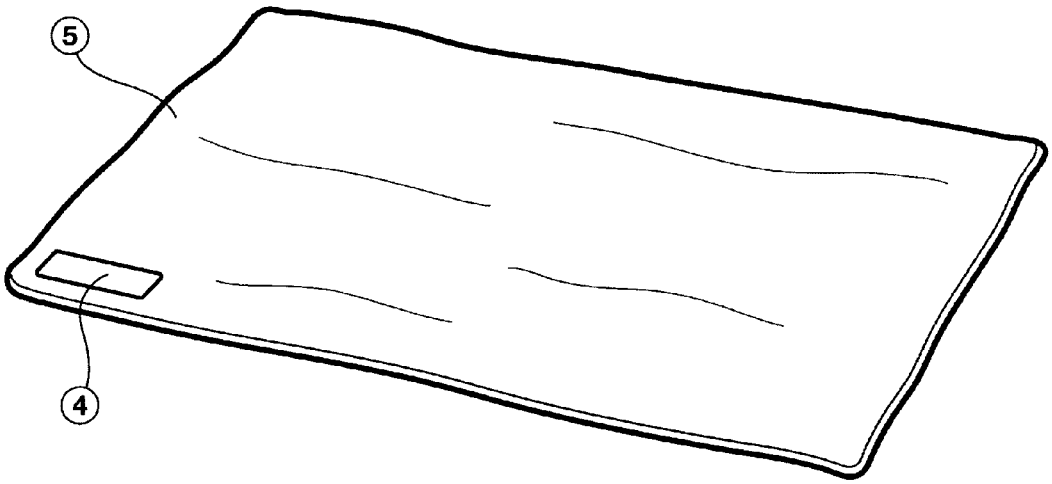
FIG. 2: is the bottom view of the towel.

FIG. 2: In this bottom side view illustration #5 is the bottom side of the towel with #4 the loop portion.

Figure 3:
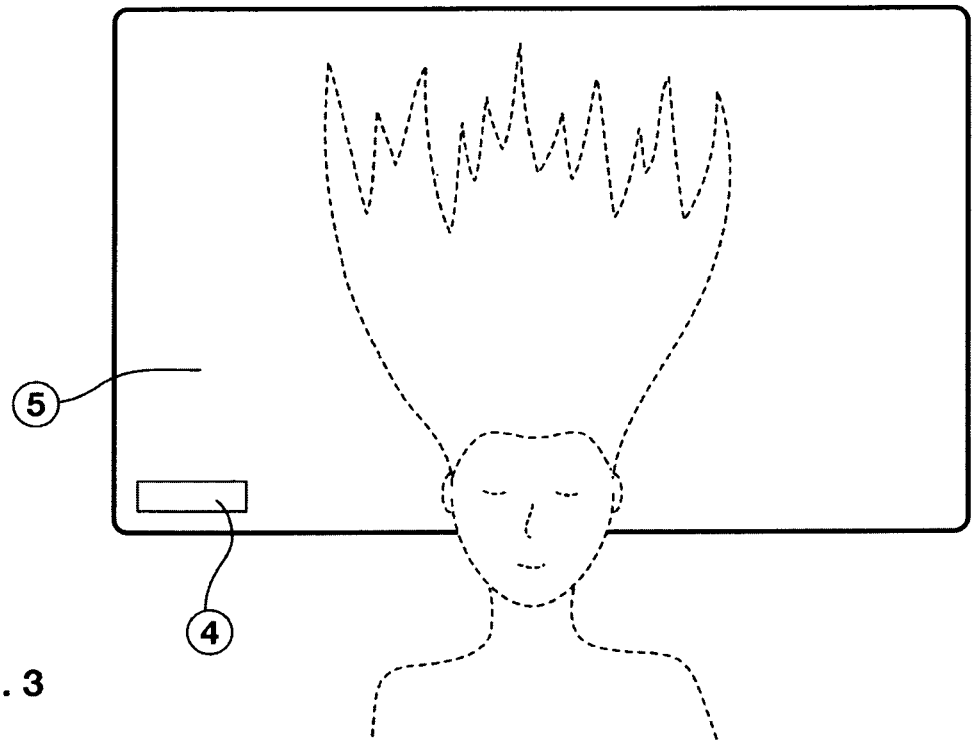
FIG. 3: is the bottom view of the towel with a person's head and hair in broken lines lying on the towel.

FIG. 3: In illustration #5 is the bottom side of the towel with #4 the loop portion with a person's hair and head in broken lines on top of the towel prior to folding the towel.

Figure 4:
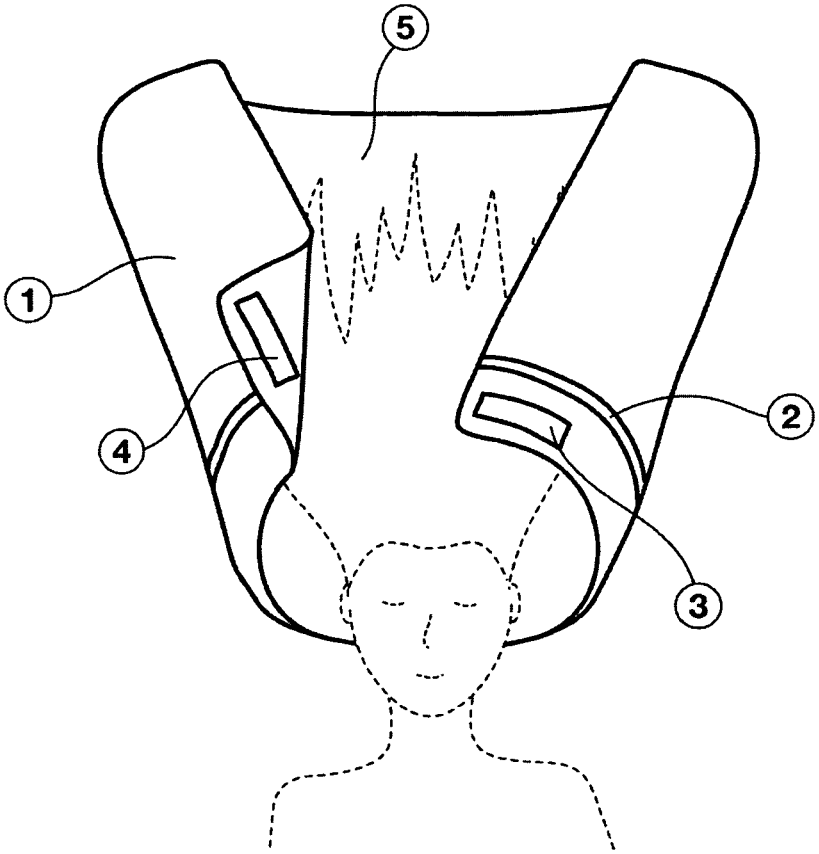
FIG. 4: is the overview of the towel being folded.

FIG. 4: In this bottom and top view of the towel being folded in illustration #1 the top side of the towel with #2 the decorative strip or logo with #3 the hook portion with #4 the loop portion of the #5 bottom side of the towel being folded around the head and hair of the person in broken lines.

Figure 5:
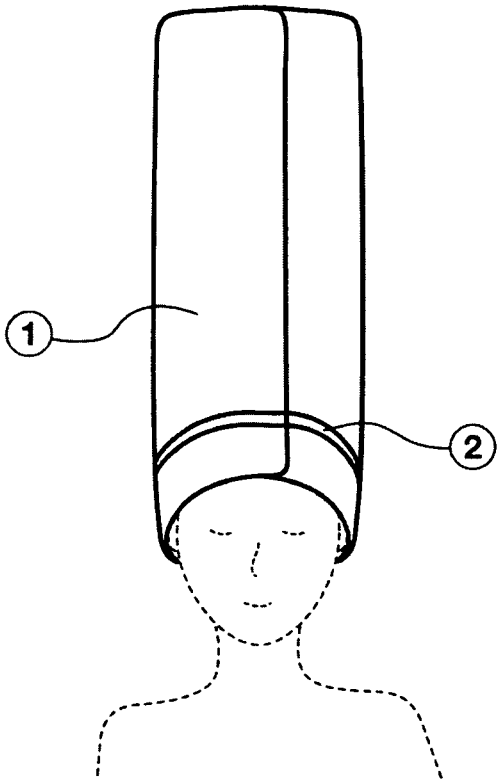
FIG. 5: is the overview of the towel completely folded and hook and loop connected on the forehead of the person in broken lines.

FIG. 5: In Illustration #1 is the top portion of the towel with #2 the decorative strip or logo in a completely folded position with the hook and loop now connected on the forehead of the person in broken lines.

Figure 6:
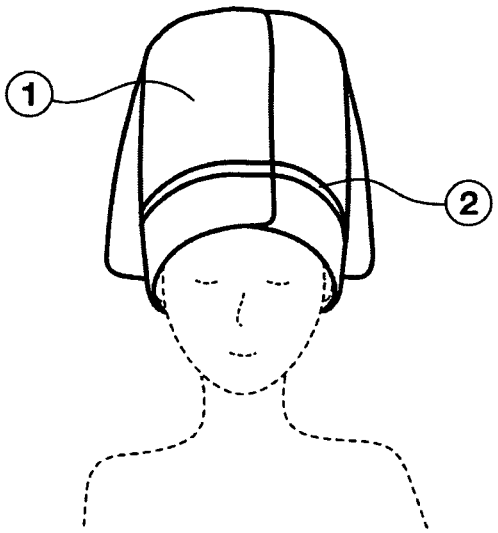
FIG. 6: is the overview of the towel completely folded and lying back on the back of the person in broken lines.

FIG. 6: In illustration #1 the top portion of the towel with #2 the decorative strip or logo in a completely folded position with the towel folded backwards to the back of the person's head in broken lines.

DETAILED DESCRIPTION OF THE INVENTION

The Wrap-n-Dry Towel is a uniquely design towel that provides a specific functionality. The traditional method of wrapping a towel around your head and especially for women, is to keep the water from dripping from the hair once the hair has been washed. The towel is typically wrapped around the head of hair tightly and usually spun around into a knot so to speak and it pulls on the hair possibly breaking strands of hair and creating tangles in the hair. It is also wrapped into a turban shape and lays on top of the head sometimes with the end of the towel tucked into the wrapped portion of the towel to hold into place. With the Wrap-n-Dry towel it is done very differently. The wrap-n-dry towel is not wrapped at al really or not into a knot to be sure. It has a hook portion and a loop portion on opposite sides of the towel much like a Velcro product that when placed together makes a connection that cannot be separated unless a person wants to separate them. When the hook and loop portion are connected at the forehead of the person using the towel it forms a slight overlap on the top of the head and the towel extends down the back side of the person wearing it. This simple method of use allows the hair to dry faster having a more open style with the hair hanging loosely down the back instead of being coiled up in a tight fashion. It also prevents the hair from becoming tangled because it is hanging loose. It is much easier to use and will not come loose while the hair is drying. This is very good for a professional person in a salon or spa environment and is a preferred method used by the inventor. It is also great for the average consumer because it is faster and easier with a faster drying benefit and it will not tangle the hair making it easier to brush the hair out. The hair is healthier with much less strand breakage.

What is claimed is:

1. A towel wrap encompassing a human head comprising:

i) a towel comprising
  (1) a rectangular shape comprising;
    (a) a lesser planar dimension, and
    (b) a greater planar dimension;
  (2) a top side;
  (3) a bottom side; and
  (4) a crease that only runs perpendicular to said greater planar dimension;

ii) a rectangular shaped hook material;

iii) a rectangular shaped loop material;

iv) a functional indicia;

v) wherein said greater planar dimension of said towel is sized such that said greater planar dimension is substantially greater than a circumference of a human user's head but less than a sum of two circumferences of the human user's head plus a longer dimension of said rectangular shaped hook material and a longer dimension of said rectangular shaped loop material;

vi) wherein said lesser planar dimension of said towel is sized such that a majority of said lesser planar dimension is consumed by the human user's hair when the human user wraps said town around the human user's head and hair;

vii) wherein said lesser planar dimension of said towel is sized such that when fully wrapped around the human user's head, said lesser planar dimension spans from a front portion of the human users head to a rear portion of the human user's head but not below the neck of the human user;

viii) wherein said rectangular shaped hook material and said functional indicia are structurally affixed the said top side of said towel;

ix) wherein said rectangular shaped loop material is structurally affixed to said bottom side of said towel;

x) wherein said rectangular shaped hook material and said rectangular shaped loop material are sized and positioned on said greater planar dimension, and further structured such that when the user wraps said towel around the user's head—that said rectangular shaped hook material and said rectangular shaped loop material sufficiently overlap such that said rectangular shaped hook material and said rectangular shaped loop material sufficiently over-lap to create sufficient coupling force to friction-affix said towel to the user's head; and xi) wherein said functional indicia is structured and arranged to provide at least one indication to the human user that wraps said towel around the human user's head as to which side of said towel is said top side of said towel during the time-period in which the human user is wrapping said towel around the human user's head.

2. The towel wrap of claim 1 wherein said towel is structured and arranged with said crease that only runs perpendicular to said greater planar dimension and that crosses through a center point of said top side of said towel.

3. The towel wrap of claim 2 wherein said wherein said towel is structured and arranged with said crease that creates an open area, located about said crease, in a mid-section of said towel, whereby said open area is structured and arranged to enable drying of the human's wet hair and further structured and arranged to prevent the human's wet hair from tangling.

* * * * *